US006786283B2

(12) United States Patent
Freeman et al.

(10) Patent No.: US 6,786,283 B2
(45) Date of Patent: Sep. 7, 2004

(54) METHODS AND ASSOCIATED APPARATUS FOR DRILLING AND COMPLETING A WELLBORE JUNCTION

(75) Inventors: Tommie A. Freeman, Flower Mound, TX (US); James R. Longbottom, Magnolia, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/246,908

(22) Filed: Sep. 19, 2002

(65) Prior Publication Data

US 2003/0042024 A1 Mar. 6, 2003

Related U.S. Application Data

(62) Division of application No. 09/537,031, filed on Mar. 28, 2000, now Pat. No. 6,454,006.

(51) Int. Cl.[7] ..... E21B 7/08; E21B 29/06

(52) U.S. Cl. ..... 166/298; 166/50; 166/117.6; 175/61; 175/80; 175/81; 175/82

(58) Field of Search ..... 175/79, 80, 81, 175/82, 61; 166/117.6, 117.5, 50, 313, 376, 298

(56) References Cited

U.S. PATENT DOCUMENTS

| | | | | |
|---|---|---|---|---|
| 2,173,035 A | | 9/1939 | Armentrout et al. | |
| 2,509,144 A | * | 5/1950 | Grable et al. | 175/81 |
| 3,082,823 A | | 3/1963 | Hower | |
| 3,467,208 A | | 9/1969 | Kelly, Jr. | |
| 3,612,181 A | | 10/1971 | Brooks, Jr. | |
| 3,782,466 A | | 1/1974 | Lawson et al. | |
| 3,933,204 A | | 1/1976 | Knapp | |
| 3,960,801 A | | 6/1976 | Cole et al. | |
| 3,976,135 A | | 8/1976 | Anderson | |
| 4,042,031 A | | 8/1977 | Knapp | |
| 4,072,194 A | | 2/1978 | Cole et al. | |
| 4,101,474 A | | 7/1978 | Copeland et al. | |
| 4,113,015 A | | 9/1978 | Meijs | |
| 4,189,002 A | | 2/1980 | Martin | |
| 4,215,001 A | | 7/1980 | Elphingstone et al. | |
| 4,220,566 A | | 9/1980 | Constien et al. | |
| 4,272,384 A | | 6/1981 | Martin | |
| 4,336,842 A | | 6/1982 | Graham et al. | |
| 4,436,165 A | | 3/1984 | Emery | |
| 4,444,265 A | | 4/1984 | Schmidt | |
| 4,483,888 A | | 11/1984 | Wu | |
| 4,489,785 A | | 12/1984 | Cole | |
| 4,665,988 A | | 5/1987 | Murphey et al. | |

(List continued on next page.)

FOREIGN PATENT DOCUMENTS

| | | |
|---|---|---|
| GB | 2328463 A | 2/1999 |
| WO | WO 90/00131 A | 1/1990 |
| WO | WO 91/02703 A | 3/1991 |
| WO | WO 93/00173 A | 1/1993 |
| WO | WO 94/12445 A | 6/1994 |

OTHER PUBLICATIONS

European Search Report for Application No.: GB 0107743.7.

*Primary Examiner*—Hoang Dang
(74) *Attorney, Agent, or Firm*—J. Richard Konneker; Marlin R. Smith

(57) ABSTRACT

Apparatus and methods are provided which enhance drilling and completion of wellbore intersections. In a described embodiment, a cutting tool diverter is used to drill a branch wellbore extending outwardly from a main wellbore. The diverter is provided with an outer easily millable portion which reduces the amount of time needed to retrieve the diverter. In another embodiment, a substance is injected into a formation surrounding the intersection of the main and branch wellbores, to thereby facilitate sealing of the intersection.

11 Claims, 4 Drawing Sheets

U.S. PATENT DOCUMENTS 4,741,401 A 5/1988 Walles et al.
4,765,404 A * 8/1988 Bailey et al. ..... 166/117.6
4,785,884 A 11/1988 Armbruster
4,921,047 A 5/1990 Summers et al.
4,928,763 A 5/1990 Falk
4,972,906 A 11/1990 McDaniel
5,159,980 A 11/1992 Onan et al.
5,168,928 A 12/1992 Terry et al.
5,211,234 A 5/1993 Floyd
5,289,876 A 3/1994 Graham
5,293,938 A 3/1994 Onan et al.
5,314,023 A 5/1994 Dartez et al.
5,325,723 A 7/1994 Meadows et al.
5,335,726 A 8/1994 Rodrigues
5,337,824 A 8/1994 Cowan
5,358,044 A 10/1994 Hale et al.
5,358,051 A 10/1994 Rodrigues
5,361,841 A 11/1994 Hale et al.
5,361,842 A 11/1994 Hale et al.
5,363,918 A 11/1994 Cowan et al.
5,368,102 A 11/1994 Dewprashad et al.
5,373,901 A 12/1994 Norman et al.
5,377,757 A 1/1995 Ng
5,388,648 A 2/1995 Jordan, Jr.
5,443,129 A 8/1995 Bailey et al.
5,458,195 A 10/1995 Totten et al.
5,462,120 A 10/1995 Gondouin
5,474,126 A * 12/1995 Lynde et al. ..... 166/117.6
5,547,027 A 8/1996 Chan et al.
5,559,086 A 9/1996 Dewprashad et al.
5,564,503 A 10/1996 Longbottom et al.
5,735,350 A * 4/1998 Longbottom et al. ..... 166/313
5,787,978 A 8/1998 Carter et al.
5,873,413 A 2/1999 Chatterji et al.
5,875,845 A 3/1999 Chatterji et al.
5,896,927 A 4/1999 Roth et al.
5,937,955 A 8/1999 Nims et al.
5,957,204 A 9/1999 Chatterji et al.
6,006,835 A 12/1999 Onan et al.
6,012,516 A * 1/2000 Brunet ..... 166/50
6,015,012 A 1/2000 Reddick
6,070,667 A * 6/2000 Gano ..... 166/313
6,189,616 B1 * 2/2001 Gano et al. ..... 166/298
6,230,804 B1 5/2001 Mueller et al.
6,244,344 B1 6/2001 Chatterji et al.

* cited by examiner

METHODS AND ASSOCIATED APPARATUS FOR DRILLING AND COMPLETING A WELLBORE JUNCTION

This is a division, of application Ser. No. 09/537,031, filed Mar. 28, 2000, now U.S. Pat. No. 6,454,006, such prior application being incorporated by reference herein entirety.

BACKGROUND OF THE INVENTION

The present invention relates generally to operations performed in conjunction with subterranean wells and, in an embodiment described herein, more particularly provides methods and apparatus for drilling and completing a wellbore junction.

A continuing need exists for apparatus and methods which facilitate economical and time conserving completions of wells. Specifically, the drilling and completions of wells wherein intersecting wellbores are to be formed demand relatively complex apparatus and time-consuming procedures which, accordingly, tend to be relatively expensive. Thus, the need for improved apparatus and methods for drilling and completing intersecting wellbores is even greater than that for wells in general.

In particular, where intersecting wellbores are to be formed in a well, it is desirable to minimize the number of trips into the well and the amount of time spent performing operations during each trip. Therefore, it would be desirable to provide apparatus and methods which permit operations to be combined within a single trip, and which reduce the amount of time spent performing each operation.

In this regard, it is sometimes appropriate to retrieve a whipstock from a well after drilling a branch wellbore by using a milling tool to mill away a portion of the whipstock. Such milling operations tend to be very time-consuming. Thus, it would be advantageous to provide apparatus and methods which reduce the amount of time spent milling whipstocks.

Additionally, a problem arises when intersecting wellbores are formed as to how to seal the intersection between the wellbores. One facet of this problem relates to how to isolate a formation adjacent or surrounding the wellbore intersection from the wellbores themselves. Another facet of this problem relates to how to isolate fluids produced from, or injected into, formations intersected by each wellbore from those produced from, or injected into, other wellbores, and other portions of the same wellbore. Therefore, it would be advantageous to provide apparatus and methods which facilitate economical and convenient wellbore intersection sealing.

SUMMARY OF THE INVENTION

In carrying out the principles of the present invention, in accordance with an embodiment thereof, apparatus and methods are provided which permit the forming and completion of wellbore intersections in a convenient, efficient and economical manner.

In one aspect of the present invention, apparatus for use in completing a subterranean well is provided. The apparatus includes a cutting tool diverter assembly in which a diverter thereof has a relatively easily millable outer portion. For retrieval of the diverter, a method is provided in which the diverter outer portion is milled, for example, by a washover shoe.

The apparatus may include a packer engagement assembly which serves to provide engagement between the diverter assembly and a packer of the apparatus. The packer engagement assembly may include a latching device for releasably securing the diverter assembly relative to the packer. The packer engagement assembly may include an orienting device for orienting the diverter assembly relative to the packer. The packer engagement assembly may also permit fluid communication between an inner fluid passage of the diverter assembly and a pressure setting port of the packer.

In another aspect of the present invention, a method is provided in which a wellbore intersection is sealed by injecting a substance into a formation surrounding or adjacent the wellbore intersection. The injection operation may be performed after a first portion of a branch wellbore is drilled, but before a second portion is drilled. After the second portion is drilled, a tubular member is positioned in the branch wellbore so that one end of the tubular member is within the first portion and the other end is within the second portion. The tubular member is sealingly engaged in the branch wellbore first portion, thereby isolating the formation surrounding the wellbore intersection from the intersecting wellbores.

These and other features, advantages, benefits and objects of the present invention will become apparent to one of ordinary skill in the art upon careful consideration of the detailed descriptions of representative embodiments of the invention hereinbelow and the accompanying drawings.

DETAILED DESCRIPTION

Figure 1:
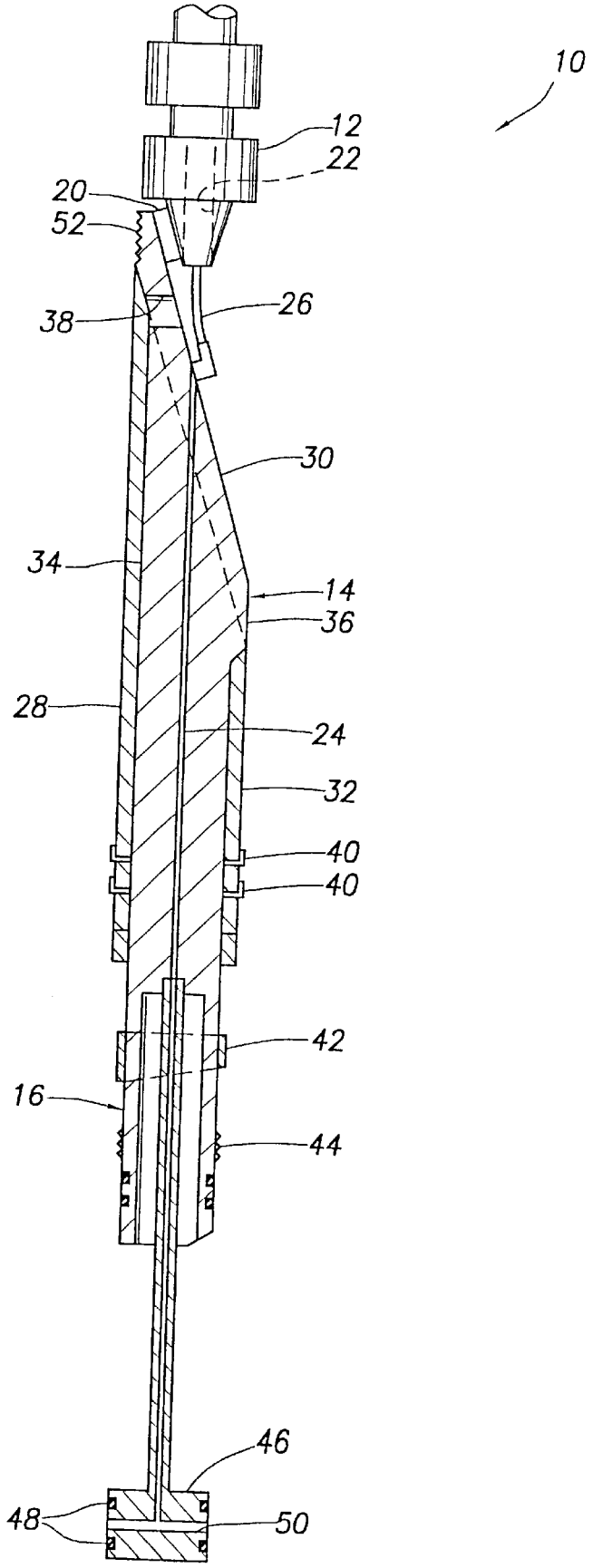
FIG. 1 is a cross-sectional view of an apparatus including a cutting tool diverter assembly, the apparatus embodying principles of the present invention.

Representatively illustrated in FIG. 1 is an apparatus 10 which embodies principles of the present invention. In the following description of the apparatus 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical etc., without departing from the principles of the present invention.

The apparatus 10 includes a cutting tool 12, a cutting tool diverter assembly 14, and a packer engagement assembly 16. The apparatus 10 may also include other items of equipment, such as a packer 18 (not shown in FIG. 1, see FIGS. 2–6), in which case the packer is conveyed into a well along with the apparatus. Alternatively, the apparatus 10 may be conveyed into the well and engaged with the packer 18 after the packer has been set therein.

The apparatus 10 is conveyed into the well suspended from a tubular string, such as a drill string, with the cutting tool 12 attached at the lower end of the string in a conventional manner. The cutting tool 12 is representatively illustrated as a conventional window mill, which is used to form an opening in casing lining a wellbore, although other types of cutting tools may be used with the apparatus 10. An attachment is provided between the mill 12 and the diverter assembly 14 by a conventional attachment block 20 of the type well known to those skilled in the art. It is not necessary, however, for the mill 12 to be attached to the diverter assembly 14 since, for example, they may be separately conveyed into the well.

An inner fluid passage 22 of the mill 12, which is typically used to transmit drilling mud, etc. through the mill, is in fluid communication with an inner fluid passage 24 extending generally longitudinally through the diverter assembly 14. A line 26 interconnected between the mill 12 and the diverter assembly 14 provides such fluid communication. As described in more detail below, the passages 22, 24 may be used to set the packer 18 in the well, which enhances the convenience of this operation when the packer is conveyed into the well with the apparatus 10.

The diverter assembly 14 includes a cutting tool diverter or whipstock 28. The whipstock 28 includes an upper laterally sloped deflection surface 30 for laterally deflecting the mill 12 and/or other cutting tools relative to a wellbore in which the apparatus 10 is positioned. This cutting tool lateral deflection is used to form a branch wellbore extending outwardly from a main wellbore in a manner described more fully below.

The whipstock 28 is constructed with an outer sleeve 32 at least partially circumscribing an inner generally cylindrical core 34. In one feature of the present invention, the whipstock 28 is made more conveniently retrievable by constructing the outer sleeve 32 of a material which is more readily millable than the inner core 34. Additionally, although the sleeve 32 is depicted in FIG. 1 as only partially outwardly overlying the inner core 34, it is to be understood that the sleeve may completely outwardly surround the core, or any portion thereof, without departing from the principles of the present invention.

The sleeve 32 is more readily milled than the inner core 34, that is, less time is required to mill the sleeve than if it were made of the same material as the inner core. As used herein, the term "milling index" is used to indicate the relative amount of time required to mill material of which an element is constructed. For example, the material of which the sleeve 32 is constructed has a milling index greater than that of the material of which the inner core 34 is constructed, since, as described above, the sleeve is more readily milled than the inner core.

The sleeve 32 material may have a greater milling index than the inner core 34 material due to a variety and/or combination of factors. For example, the sleeve 32 may be made of a material having a hardness less than that of the inner core 34 material. The sleeve 32 material may otherwise be more readily milled than the inner core material 34, such as, due to the sleeve being made of an easily machined material. The sleeve 32 may be made of a composite material, for example, a composite material which includes graphite fibers, etc. Thus, it will be readily appreciated that the sleeve 32 material may be any material which has a milling index greater than that of the inner core 34 material.

Note that, as depicted in FIG. 1, the inner core 34 includes an upper radially outwardly extending support portion 36 adjacent the sloped surface 30. The support portion 36 laterally supports the whipstock 28 within the wellbore in which it is positioned during milling and drilling operations, as described more fully below. This support may be needed when the sleeve 32 is constructed of a material incapable of withstanding the lateral forces generated by the milling and drilling operations. However, it is to be clearly understood that it is not necessary in keeping with the principles of the present invention for the support 36 to be provided on the whipstock 28, since the sleeve 32 may be made of a material which is capable of withstanding these lateral forces. Additionally, although the support 36 is shown as an outwardly extending portion of the inner core 34 which extends circumferentially about the inner core, the support 36 may be separately formed, may be otherwise positioned, and may extend other than circumferentially relative to the inner core, without departing from the principles of the present invention. Note that the support 36 may optionally include a serrated or grooved portion 52 to permit a washover shoe to more easily catch the upper edge of the whipstock 28.

The whipstock 28 further includes debris barriers 40 and an opening 38 formed into the surface 30. The opening 38 provides an alternate or additional means of retrieving the assembly 14 from the well, for example, by engaging the opening with a "hook" for applying an upwardly directed force to the whipstock 28. The debris barriers 40 aid in excluding debris from the window milling and branch wellbore drilling operations from settling about the packer 18 and packer engagement assembly 16.

Figure 2:
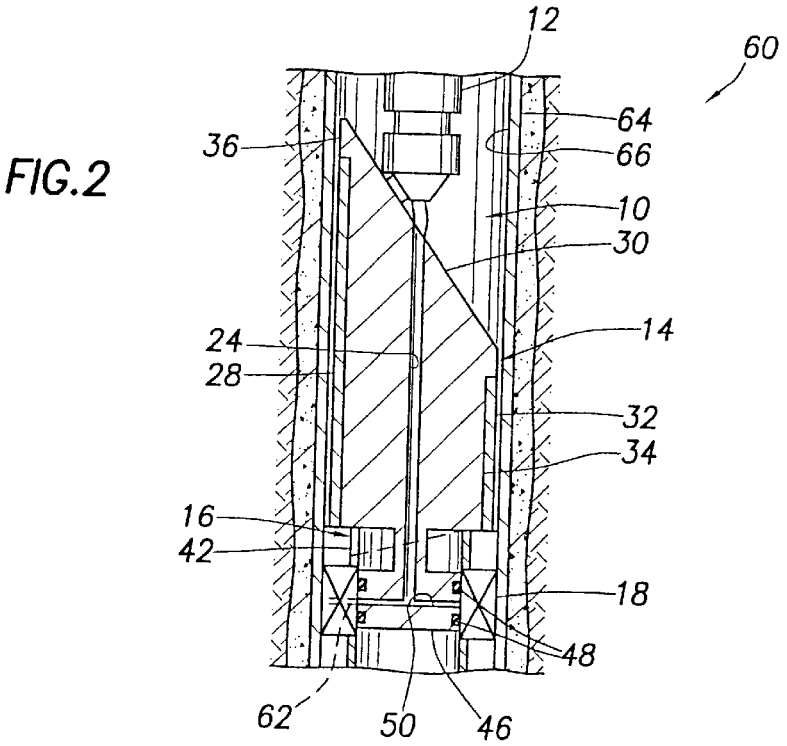
FIGS. 2–6 are cross-sectional views of a well in which successive steps of a method of drilling and completing the well using the apparatus of FIG. 1 are shown, the method embodying principles of the present invention.

The packer engagement assembly 16 includes an orienting device 42, a latching device 44, and a sealing device 46. The orienting device 42 is used to radially orient the diverter assembly 14 relative to the packer 18. For example, the orienting device 42 may engage an upper sloped "muleshoe head" of the packer 18 as shown in FIG. 2 to thereby radially orient the surface 30 toward a desired location for drilling a branch wellbore. Of course, other types of orienting devices, and other methods of radially orienting the assembly 14 within the well, may be utilized without departing from the principles of the present invention.

The latching device 44 is used to releasably secure the assembly 14 to the packer 18. The latching device 44 may be a conventional set of dogs, keys or lugs configured for engagement with a corresponding internal profile attached to, or formed on, the packer 18 in a manner well known to those skilled in the art. Alternatively, the latching device 44 may be of the threaded type, such as a RATCH-LATCH™ available from Halliburton Energy Services, Inc. of Dallas, Tex.

The sealing device 46 includes seals 48 which straddle a fluid passage 50 formed in the sealing device. The fluid passage 50 is in fluid communication with the passage 24. The sealing device 46 is sealingly engaged within an inner seal bore of the packer 18, so that the seals 48 straddle a pressure setting port of the packer, and the passage 50 is thereby placed in fluid communication with the pressure setting port. Of course, it is well known that a hydraulically settable packer typically has a port to which pressure is applied in order to set the packer. It will be readily appreciated by a person skilled in the art that the packer 18 may, thus, be set by applying fluid pressure to the tubular string on which the apparatus 10 is conveyed, the fluid pressure being transmitted to the pressure setting port of the packer via the passages 22, 24, 50.

Referring additionally now to FIGS. 2–6, a method 60 of drilling and completing a wellbore intersection is representatively and schematically illustrated. The method 60 utilizes the apparatus 10 described above, but it is to be clearly understood that other apparatus, and other types of apparatus, may be utilized in the method without departing from the principles of the present invention.

As depicted in FIG. 2, the apparatus 10, including the packer 18, has been conveyed into and positioned within the well. The packer 18 has been set by applying fluid pressure to the passage 50 as described above, the pressure being communicated to a pressure setting port 62 of the packer. Preferably, the packer 18 is set in casing 64 lining a main wellbore 66 of the well, with the surface 30 facing toward a desired location for drilling a branch wellbore. Such orientation of the apparatus 10 may be accomplished using conventional techniques such as by use of a gyroscope, high side indicator, etc.

If, however, the packer 18 is set in the wellbore 66 before the diverter assembly 14 is conveyed into the well, the packer engagement assembly 16 may be used to engage the diverter assembly with the packer and radially orient the diverter assembly relative to the packer, but the fluid passages 22, 24, 50 and sealing device 46 would not be used to set the packer. Thus, it will be appreciated that various methods of positioning the apparatus 10 in the wellbore 66, with or without the packer 18 attached thereto, may be utilized, without departing from the principles of the present invention.

Figure 3:
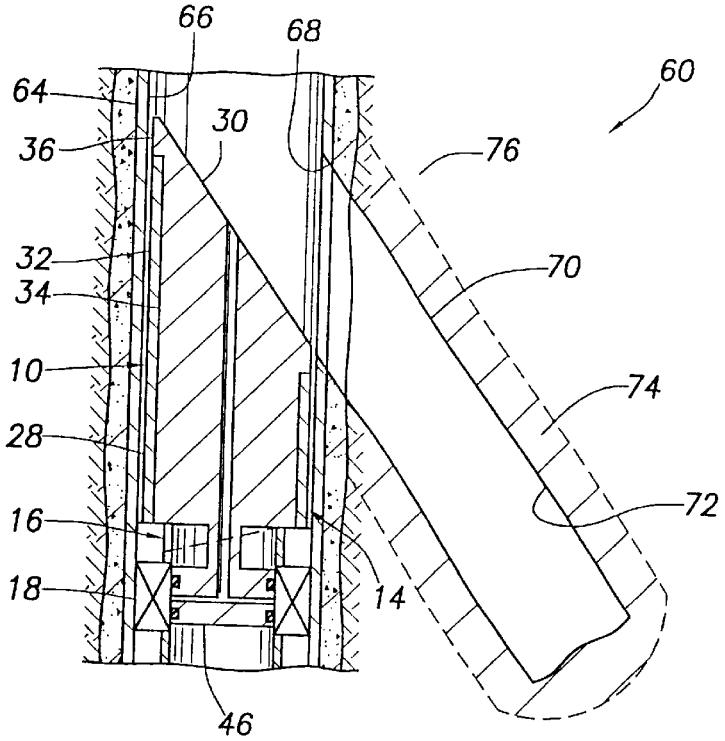

In FIG. 3, it may be seen that a window 68 has been milled through the casing 64 by laterally deflecting the mill 12 off of the surface 30 of the whipstock 28. Thereafter, an initial portion 70 of a branch wellbore 72 is drilled extending outwardly from the main wellbore 66. The portion 70 may be drilled using the mill 12 and/or one or more other cutting tools, which are laterally deflected by the whipstock 28 from the main wellbore 66 through the window 68.

After the portion 70 is drilled, a substance 74 is injected into a formation 76, or portion of the formation, surrounding the intersection of the wellbores 66, 72. The substance 74 may, for example, be flowed into the wellbore portion 70 and pressure applied thereto in order to force the substance into pores of the formation 76 about the branch wellbore 72. It is to be clearly understood that any method of injecting the substance 74 into the formation 76 may be utilized, without departing from the principles of the present invention.

The substance 74 is used to aid in sealing the intersection of the wellbores 66, 72. The substance 74 may prevent fluid flow through the formation 76 by hardening within the pores of the formation. In that case, the substance 74 may be a hardenable epoxy resin composition as described in an application having Ser. No. 09/018,924, entitled LATERAL WELLBORE CONNECTION, filed Feb. 5, 1998, the disclosure of which is incorporated herein by this reference. However, other substances capable of preventing fluid flow through the formation 76, and other types of substances, may be used in the method 60 without departing from the principles of the present invention.

Figure 4:
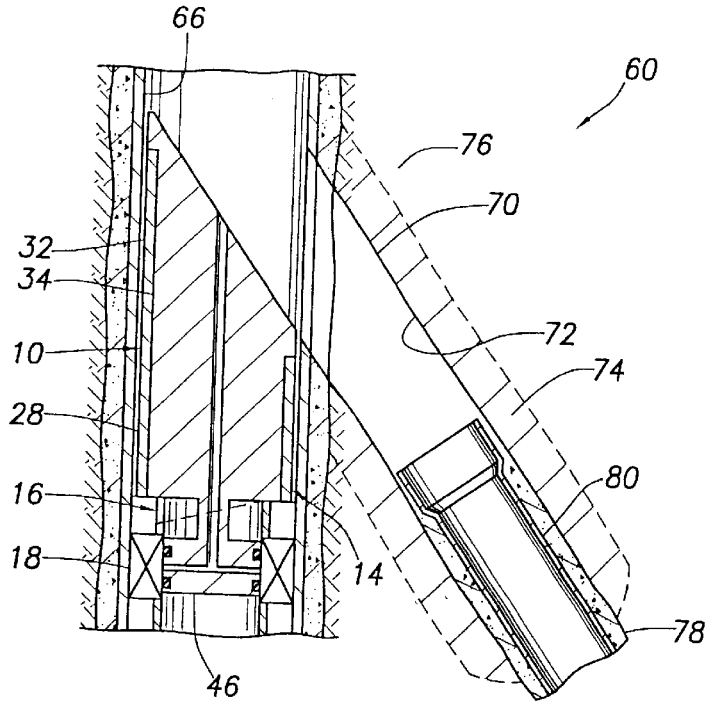

As depicted in FIG. 4, further steps of the method 60 have been performed. The branch wellbore 72 has been drilled further outward from the main wellbore 66, so that a second portion 78 of the branch wellbore is formed. A tubular member or liner 80 is then installed in the branch wellbore 72, with an upper end of the liner positioned within the initial wellbore portion 70, and a lower end of the liner positioned within the second wellbore portion 78. The liner 80 is cemented within the branch wellbore 72.

It will be readily appreciated that the method 60 has now resulted in the formation of the intersection of the wellbores 66, 72, in a manner preventing fluid communication between the wellbores and the formation 76 surrounding the wellbore intersection. The substance 74 prevents fluid flow through the formation 76 about the wellbore portion 70 proximate the main wellbore 66, and the liner 80 extends into the wellbore portion 78 and is cemented therein. Of course, the liner 80 may be perforated, provided with a screen or a slotted liner portion, etc. to provide fluid communication as desired to produce or inject fluid therethrough.

Figure 5:
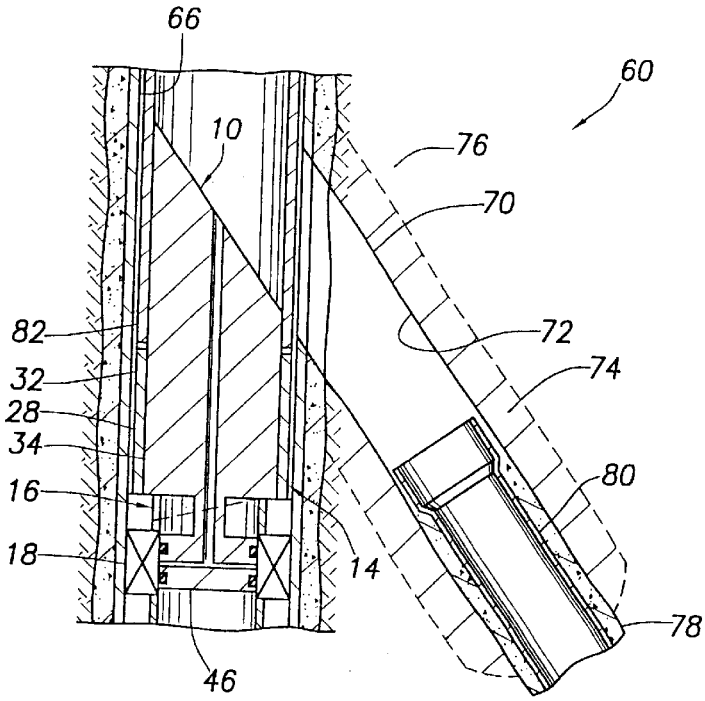

As depicted in FIG. 5, a washover shoe 82 is being used to mill the sleeve 32 in order to facilitate retrieval of the apparatus 10 from the well after the window milling and wellbore drilling operations. It may now be fully appreciated that the increased milling index of the sleeve 32 relative to the inner core 34 permits increased efficiency in performing this operation. Once the sleeve 32 has been milled as desired, the apparatus 10 is retrieved from the well using conventional techniques.

Figure 6:
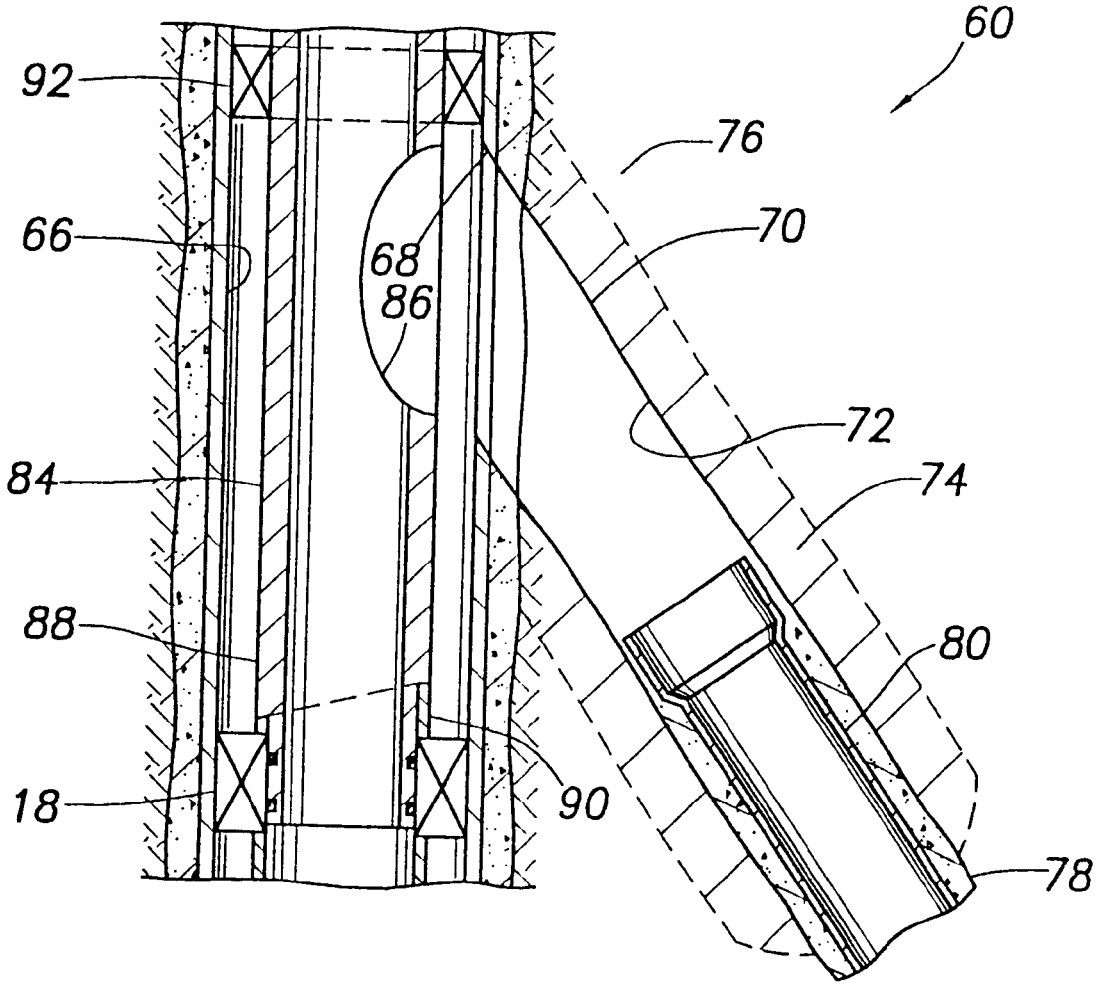

In FIG. 6, it may be seen that the apparatus 10 has been retrieved from the well. A generally tubular housing 84 having a preformed opening 86 in a sidewall thereof is installed in the main wellbore 66, so that the opening 86 is generally aligned with, and oriented to face toward, the window 68. For radially orienting the housing 84, it may have an orienting device 88 thereon configured to engage the muleshoe head 90 of the packer 18, similar to the manner in which the diverter assembly 14 is oriented relative to the packer. Of course, other orienting devices, and other methods of radially orienting the housing 84, may be utilized in keeping with the principles of the present invention.

A packer 92 is set in the wellbore 66 above the housing 84 and above the window 68, and the housing is sealingly engaged with the packer 18 below the window. Thus, it may be seen that at this point the intersection of the wellbores 66, 72 is isolated from all other portions of the well, except via the liner 80, which is sealed within the branch wellbore 72, and the housing 84, which is sealed within the main wellbore 66. The method 60, therefore, conveniently achieves isolation of the wellbore intersection from the formation 76 surrounding the intersection, and isolation of the intersection from other portions of the well, while permitting access to both of the wellbores below the intersection via the housing 84.

Of course, upon a careful reading of the above description of the apparatus 10 and method 60, numerous modifications, additions, substitutions, deletions, and other changes would be readily apparent to a person skilled in the art, and such changes are encompassed by the principles of the present invention. Accordingly, the foregoing detailed description is to be clearly understood as being given by way of illustration and example only, the spirit and scope of the present invention being limited solely by the appended claims.

What is claimed is:

1. Apparatus operatively positionable within a subterranean well, the apparatus comprising:

a cutting tool diverter assembly including a cutting tool diverter having an inner core and a structure outwardly disposed relative to the inner core, the structure having a milling index greater than that of the inner core, the cutting tool diverter including a support configured for radially supporting the diverter assembly within a wellbore, the support being formed as an outwardly extending portion of the inner core.

2. The apparatus according to claim 1, wherein:

the structure is constructed of a composite material.

3. The apparatus according to claim 2, wherein:

the composite material is a graphite material.

4. Apparatus operatively positionable within a subterranean well, the apparatus comprising:

a cutting tool diverter assembly including a cutting tool diverter having an inner core and a structure outwardly disposed relative to the inner core, the structure having a milling index greater than that of the inner core, the cutting tool diverter including a support configured for radially supporting the diverter assembly within a wellbore, the support being formed adjacent a laterally sloped deflection surface of the cutting tool diverter.

5. Apparatus operatively positionable within a subterranean well, the apparatus comprising:

a cutting tool diverter assembly including a cutting tool diverter having an inner core and a structure outwardly disposed relative to the inner core, the structure having a milling index greater than that of the inner core, the cutting tool diverter including a support configured for radially supporting the diverter assembly within a wellbore, the support radially outwardly circumscribing the inner core.

6. Apparatus operatively positionable within a subterranean well, the apparatus comprising:

a cutting tool diverter assembly including a cutting tool diverter having an inner core and a structure outwardly disposed relative to the inner core, the structure having a milling index greater than that of the inner core, the cutting tool diverter including a support configured for radially supporting the diverter assembly within a wellbore, the support being formed as an outwardly extending portion of the inner core; and a packer and a packer engagement assembly configured for engaging the diverter assembly with the packer, the packer engagement assembly including a sealing device providing sealed fluid communication between a pressure setting port of the packer and an inner fluid passage of the diverter assembly.

7. The apparatus according to claim 6, wherein the packer engagement assembly includes a latching device for releasably securing the diverter assembly to the packer.

8. The apparatus according to claim 6, wherein the packer engagement assembly includes an orienting device for orienting the diverter assembly relative to the packer.

9. The apparatus according to claim 6, further comprising a cutting tool releasably secured relative to the diverter assembly.

10. The apparatus according to claim 9, wherein an inner fluid passage of the cutting tool is in fluid communication with the diverter assembly fluid passage.

11. A method of completing a subterranean well, comprising the steps of:

positioning a cutting tool diverter within a main wellbore of the well;

drilling a branch wellbore extending outwardly from the main wellbore by deflecting at least one cutting tool with the diverter; and milling an outer portion of the diverter, the outer portion having a milling index greater than that of an inner core of the diverter, wherein in the drilling step, the outer portion laterally supports the diverter within the main wellbore.

* * * * *